US010142715B2

(12) United States Patent
Ivey et al.

(10) Patent No.: US 10,142,715 B2
(45) Date of Patent: Nov. 27, 2018

(54) SMALL SPEAKER SYSTEM

(71) Applicant: Mitek Corp., Inc., Phoenix, AZ (US)

(72) Inventors: Johnathan Ivey, Chandler, AZ (US); Kevin Sykes, Phoenix, AZ (US); Kenneth Wade Chappell, Midlothian, TX (US)

(73) Assignee: Mitek Corp, Inc., Phoenix, AZ (US)

( * ) Notice: Subject to any disclaimer, the term of this patent is extended or adjusted under 35 U.S.C. 154(b) by 128 days.

(21) Appl. No.: 15/238,348

(22) Filed: Aug. 16, 2016

(65) Prior Publication Data

US 2018/0054665 A1 Feb. 22, 2018

(51) Int. Cl.
*H04R 1/02* (2006.01)
*H04R 1/34* (2006.01)

(52) U.S. Cl.
CPC ..... *H04R 1/026* (2013.01); *H04R 1/345* (2013.01); *H04R 1/025* (2013.01); *H04R 2201/021* (2013.01); *H04R 2201/025* (2013.01)

(58) Field of Classification Search
CPC ... H04R 1/026; H04R 1/345; H04R 2201/021
See application file for complete search history.

(56) References Cited

U.S. PATENT DOCUMENTS

2003/0123679 A1* 7/2003 Dudleston ..... H04R 1/025 381/87
2004/0047487 A1* 3/2004 Popken ..... H04R 1/025 381/395
2005/0123156 A1* 6/2005 Wright ..... H04R 1/025 381/182
2016/0366501 A1* 12/2016 Ivey ..... F16M 13/027

* cited by examiner

*Primary Examiner* — Regina N Holder
(74) *Attorney, Agent, or Firm* — Keith L. Jenkins, Registered Patent Attorney, LLC; Keith L. Jenkins

(57) ABSTRACT

A small speaker for panel mounting in a hole as small as seventy five millimeters diameter in which access to the rear of the panel is not required. The small speaker uses spring-loaded flip dogs that are actuated by rotating a sound disperser that is connected to a hollow cylindrical mechanism having gear teeth on its external surface which engage flip dog gears on the top surfaces of the flip dogs. Internally, the hollow cylindrical mechanism has an indentation that supports a speaker baffle which, in turn supports a speaker bushing. A loudspeaker is attached to the speaker bushing near the speaker baffle. Two housing sections attach, spaced apart, to an annular frame on opposing sides and receive the hollow cylindrical mechanism rotationally therein. The flip dogs operate in the spaces between the housing sections. Methods of mounting and dismounting are described.

20 Claims, 8 Drawing Sheets

SMALL SPEAKER SYSTEM

FIELD OF ART

The present invention relates to panel-mounted speakers having a small diameter (50 mm or more) and 180° sound dispersion. The present invention further relates to panel speakers that can be installed via a flip dog mechanism actuated by manually rotating a sound dispersion element that is rotationally coupled to gears within the device.

BACKGROUND OF THE INVENTION

Suspended ceilings consisting of a grid framework within which ceiling tiles may be supported are well known. Mounting loudspeakers on the top side of a ceiling tile or specialized tile or panel designed to support a loudspeaker, with an opening in the tile for allowing the sound into the room below the tile, is also known. Many ceiling speaker installations are vast, sometimes providing sound to an entire floor or floors of a modern building to provide enunciator services, emergency alerts, and background music, are controlled as a whole, so that small areas where softer music or louder music is desired have no recourse. In the same way, ceiling lighting is generally not locally controlled in large rooms. Large ceiling speakers can burden a suspended ceiling system. Large ceiling speakers often require access to the back of the panel or ceiling tile. In the case of a panel that is not removable, rear access presets a problem. What is needed is a small ceiling or panel-mounted speaker that can be manually installed in a ceiling or panel without accessing the rear of the panel, can provide flip dog security, does not burden a ceiling or panel with a large weight load, and provides 180° sound dispersion.

SUMMARY OF THE INVENTION

Briefly described, the invention includes a small ceiling-mounted or panel-mounted speaker of unique configuration that can be manually installed in a ceiling or panel without access to the rear of the panel, provides unique flip dog security adapted for small speakers, does not burden a ceiling or panel with a large weight load, and provides 180° sound dispersion.

In a particular embodiment, a small speaker system including: an annular frame; first and second housing sections mounted on the annular frame; a hollow cylindrical mechanism snap fit to the annular frame and adapted to rotate within the first and second housing sections; and an annular indentation in an inner surface of the hollow cylindrical mechanism adapted to support a speaker baffle. That small speaker system, including a speaker supported proximate the speaker baffle. That small speaker system, including a cap receiving and covering top ends of the first and second housing sections. That small speaker system, including first and second vertical axles supported by respective axle receivers that are of one piece with the annular frame and by first and second top axle supports, respectively, extending from the cap. That small speaker system, including first and second channels on the first and second housing sections, respectively, adapted to slidingly receive first and second guides, respectively, and first and second gear teeth sections, respectively, extending from an external surface of the hollow cylindrical mechanism. That small speaker system, including first and second coil springs compressively mounted on the first and second vertical axles, respectively, between the first and second top axle supports, respectively, and first and second flip dogs, respectively, that are rotationally and slidingly mounted on the first and second axles, respectively. That small speaker system, including first and second dog gears extending upward from top surfaces of the first and second flip dogs, respectively, adapted to engage the first and second gear teeth sections, respectively, to rotate the first and second flip dogs, respectively, when the hollow cylindrical mechanism is rotated. That small speaker system, including a sound disperser attached to the hollow cylindrical mechanism adapted to enable manual rotation of the hollow cylindrical mechanism. That small speaker system, including a plurality of semi-annular teeth extending outwardly from the external surface of the hollow cylindrical mechanism and oriented horizontally in first and second vertical spaced-apart arrays on opposing sides of the hollow cylindrical mechanism. That small speaker system, including first and second flip dog teeth sections extending from a rear portion of each of the first and second flip dogs, respectively, and adapted to engage the first and second vertical spaced-apart arrays of semi-annular teeth, respectively.

In a particular embodiment, a small speaker system including: an annular frame; first and second housing sections mounted on the annular frame; a hollow cylindrical mechanism snap fit to the annular frame and adapted to rotate within the first and second housing sections; an annular indentation in an inner surface of the hollow cylindrical mechanism adapted to support a speaker baffle; and first and second channels on said first and second housing sections, respectively, adapted to slidingly receive first and second guides, respectively, and first and second gear teeth sections, respectively, extending from an external surface of the hollow cylindrical mechanism. That small speaker system, including: a cylindrical bushing inside and aligned to the hollow cylindrical mechanism and supported on the speaker baffle; and a speaker supported on the cylindrical bushing proximate the speaker baffle. That small speaker system, including: a cap receiving and covering top ends of the first and second housing sections; and first and second vertical axles supported by respective first and second receivers that are of one piece with the annular frame and by first and second top axle supports, respectively, extending from the cap. That small speaker system, including: first and second coil springs compressively mounted on the first and second axles, respectively, between the first and second top axle supports, respectively, and first and second flip dogs, respectively, where the first and second flip dogs are rotationally and slidingly mounted on the first and second axles, respectively; and first and second dog gears extending upward from top surfaces of the first and second flip dogs, respectively, adapted to engage the first and second gear teeth, respectively, to rotate the first and second flip dogs, respectively, when the hollow cylindrical mechanism is rotated. That small speaker system, including a sound disperser attached to the hollow cylindrical mechanism adapted to enable manual rotation of the hollow cylindrical mechanism. That small speaker system, including first and second semi-annular teeth sections extending outwardly from the external surface of the hollow cylindrical mechanism and oriented horizontally in first and second vertically spaced-apart arrays on opposing sides of the hollow cylindrical mechanism, respectively. That small speaker system, including first and second flip dog teeth sections extending from a rear portion of each of the first and second flip dogs, respectively, and adapted to engage the first and second vertical spaced-apart arrays of semi-annular teeth, respectively.

In a particular embodiment, a small speaker system including: an annular frame; first and second housing sections mounted on the annular frame; a hollow cylindrical mechanism snap fit to the annular frame and adapted to rotate within the first and second housing sections; an annular indentation in an inner surface of the hollow cylindrical mechanism adapted to support a speaker baffle; first and second channels on the first and second housing sections, respectively, adapted to slidingly receive first and second guides, respectively, and first and second gear teeth sections, respectively, extending from an external surface of the hollow cylindrical mechanism; a cylindrical bushing inside and aligned to the hollow cylindrical mechanism and supported on the speaker baffle; a speaker supported on the cylindrical bushing proximate the speaker baffle; a cap receiving and covering top ends of the first and second housing sections; first and second vertical axles supported by respective first and second receivers that are of one piece with the annular frame and by first and second top axle supports, respectively, extending from the cap; comprising first and second coil springs compressively mounted on the first and second vertical axles, respectively, between the first and second top axle supports, respectively, and first and second flip dogs, respectively, that are rotationally and slidingly mounted on the first and second axles, respectively; and first and second dog gears extending upward from top surfaces of the first and second flip dogs, respectively, adapted to engage the first and second gear teeth sections, respectively, to rotate the first and second flip dogs, respectively, when the hollow cylindrical mechanism is rotated. That small speaker system, including a sound disperser attached to the hollow cylindrical mechanism adapted to enable manual rotation of the hollow cylindrical mechanism. That small speaker system, including: including first and second semi-annular teeth sections extending outwardly from the external surface of the hollow cylindrical mechanism and oriented horizontally in first and second vertically spaced-apart arrays on opposing sides of the hollow cylindrical mechanism, respectively; and first and second flip dog teeth sections extending from a rear portion of each of the first and second flip dogs, respectively, and adapted to engage the first and second vertical spaced-apart arrays of semi-annular teeth, respectively.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

Figure 1:
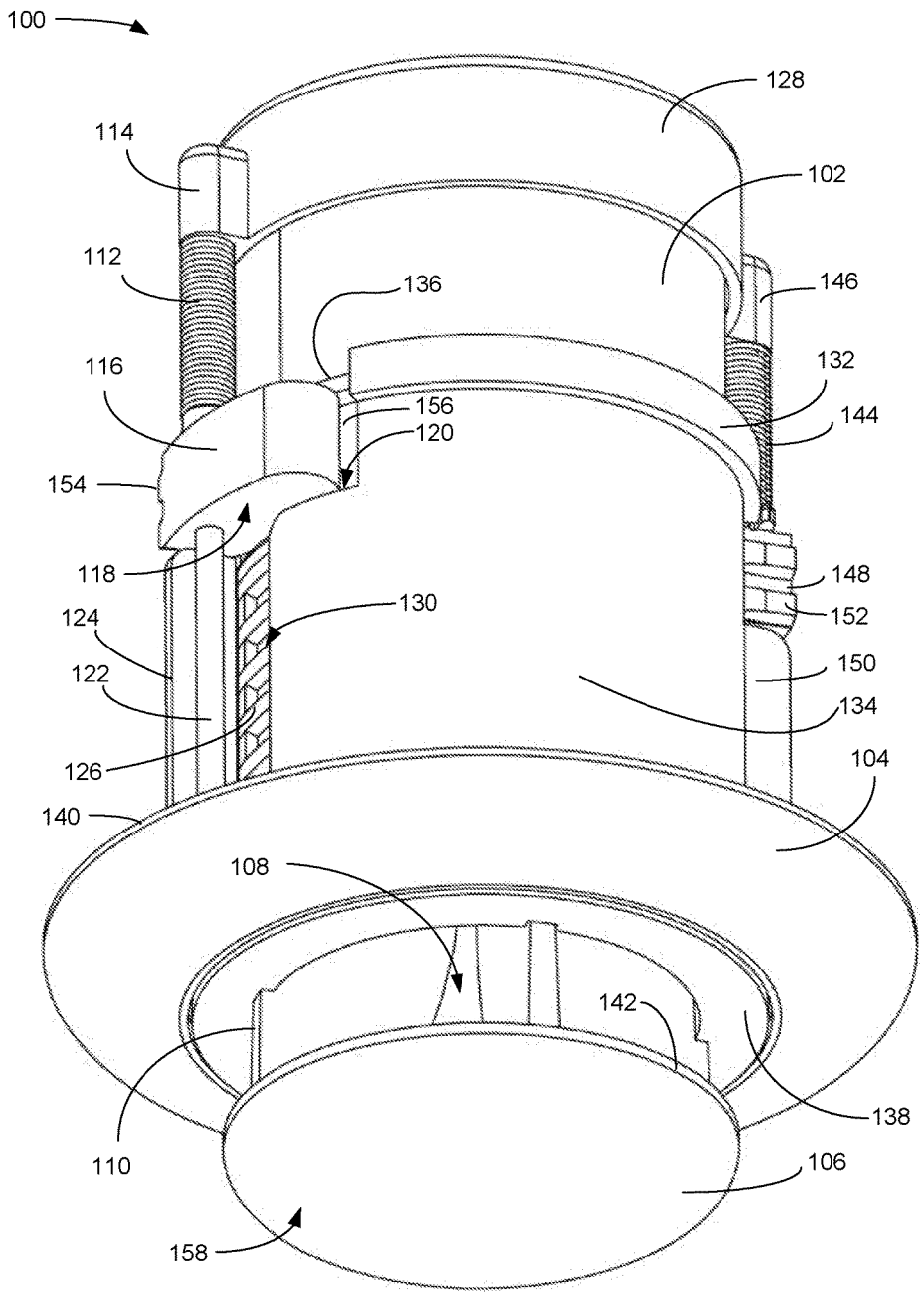
FIG. 1 is a front side-bottom perspective view illustrating an exemplary embodiment of the small speaker system in a first configuration, according to a preferred embodiment of the present invention.

As used and defined herein, "flip dog" refers to a clamping element that can be deployed by manual mechanism and, under the influence of a biasing mechanism, clamp an object against a second surface, in the sense of "dogging down a hatch". As used and defined herein, "speaker" refers to a loudspeaker using a voice coil in a magnet gap to move a diaphragm to generate sound. Directional words such as "top", "bottom", "underside" and the like, are referenced to the drawing views, and do not preclude the use of the invention in a tilted, horizontal, or upside down configuration. Reference numbers use the figure number of the drawing as the hundreds digit.

FIG. 1 is a front side-bottom perspective view illustrating an exemplary embodiment of the small speaker system 100 in a first configuration, according to a preferred embodiment of the present invention. The small speaker system 100 is first configured for installing the small speaker system 100 into a diameter hole 808 having a diameter of seventy-five millimeters or greater, in a panel 802 (See FIG. 8). Cap 128 fits over the tops of first and second housing sections 102 and 212 (See FIG. 2). Cap 128 includes first and second top axle supports 114 and 146, respectively. First housing section 102 includes channel portion 132, bottom portion 134, and semi-annular flange 304 (See FIG. 3), which are preferably all of one piece. First and second housing sections 102 and 212 (See FIG. 2) are preferably similar and are positioned spaced apart on opposing sides of the small speaker system 100. First and second housing sections 102 and 212 (See FIG. 2) do not abut, but are spaced apart at the vertical outer housing section edge 130 and first guide 124, and a similar space on the opposing side of the small speaker system 100. Annular frame 104 is attached to the first and second housings 102 and 212 (See FIG. 2) by fastening to semi-annular flanges 304 and 302 (See FIG. 3), respectively. Extending below annular frame 104 is a portion of sound disperser 106. Sound disperser 106 disperses sound in a substantially 360° pattern and has a rounded bottom surface 158 with a cylindrical upper portion 142. Sound disperser 106 includes a sloped surface of revolution 108 extending upward, which assists in dispersing the sound. In addition to sound dispersion, sound disperser 106 serves as a manual knob for concurrently deploying flip dogs 116 and 148. Fins 110 (one of three visible of four labeled) connect sound disperser 106 to annular panel 138, which is the base supporting cylindrical mechanism 156. Cylindrical mechanism 156 includes channel guide 136, which slidingly rotates within channel 132 during installation or removal of the small speaker system 100. Cylindrical mechanism 156 also includes semi-annular teeth 126 which, during deployment, engage flip dog teeth section 154 on the radially inward (when deployed) surface of the first flip dog 116. Semi-annular teeth 126 are arranged horizontally in first and second spaced apart arrays on external opposing sides of the hollow cylindrical mechanism 156. Second flip dog 148 provides a better view of flip dog teeth section 152 in this view. When activated by manual rotation of the sound disperser 106, flip dog 116 rotates outward 90° (flips) and is urged by the first spring 112 slidingly downward along axle 122 into and along a channel formed by first guide 124 of second housing section 212 (See FIG. 2) and vertical outer first housing section edge 130 of the lower portion 134 of first housing section 102. First guide 124 extends radially outward from a lower portion 208 of second housing 212 (See FIG. 2). Second flip dog 148 similarly rotates outward 90° and is urged by the second spring 144 downward along second axle 602 (See FIG. 6) into and along a channel formed by second guide 150, extending from the lower portion 134 of first housing section 102, and vertical outer second housing section edge of the lower portion of second housing section 212 (not visible in this view). Second guide 150 extends radially outward from a lower portion 134 of first housing 102.

In installation, audio signal wires are extended out of the hole 808 in the panel 802 (See FIG. 8) in which the small speaker system 100 is to be mounted. The wires are attached to connectors in the top 202 (See FIG. 2) of the cap 128 to supply the speaker 406 (See FIG. 4) with an audio signal. The wires and connectors are not illustrated, as such matters are well known and need not be detailed here. The small speaker system 100 is inserted, top first, into the opening until the top cylindrical portion 140 of the annular frame 104 abuts the panel 802 (See FIG. 8). Next, the sound disperser 106 is manually rotated to deploy the flip dogs 116 and 148.

Initially, first coil spring 112 is compressed between first axle support 114 and first flip dog 116. Second coil spring 144 is compressed between second axle support 146 and second flip dog 148. First coil spring 112 is mounted slidingly around first axle 122 and first flip dog 116 is freely rotatable about first axle 122. First flip dog 116 is constrained from moving by the abutment of lower flip dog surface 118 with the top surface of shelf 120 of bottom portion 134 of first housing section 102. First and second flip dogs 116 and 148 are preferably similar. When activated by manual rotation of the sound disperser 106, first flip dog 116 rotates outward 90°, disengages from the shelf 120, and is urged by the first coil spring 112 downward along first axle 122 into and along a channel formed by first guide 124 and the vertical outer housing section edge 130 of the lower portion of first housing section 102. First flip dog teeth section 154 engages semi-annular teeth 126 of the cylindrical mechanism 156 in a ratchet-like fashion. The panel 802 (See FIG. 8) on which the small speaker system is to be mounted is clamped between the bottom surface 118 of first flip dog 116 and a cylindrical upper portion 140 of the annular frame 104. Second flip dog 148 similarly rotates outward 90° and is urged by the second spring 144 downward along second axle 602 (See FIG. 6) into and along a channel formed by second guide 150 and a vertical outer second housing section edge of the lower portion of second housing 212 (not visible in this view). Once deployed, the flip dogs 112 and 148 remain in place by the engagement of first flip dog teeth section 154 with semi-annular teeth 126. In a particular embodiment, the small speaker system 100 may have more than two flip dogs 116 and 148. In a particular embodiment, cylindrical portion 140 of annular frame 104 may be non-cylindrical. In some embodiments, other biasing mechanisms may be used in place of coil springs 112 and 144.

Figure 2:
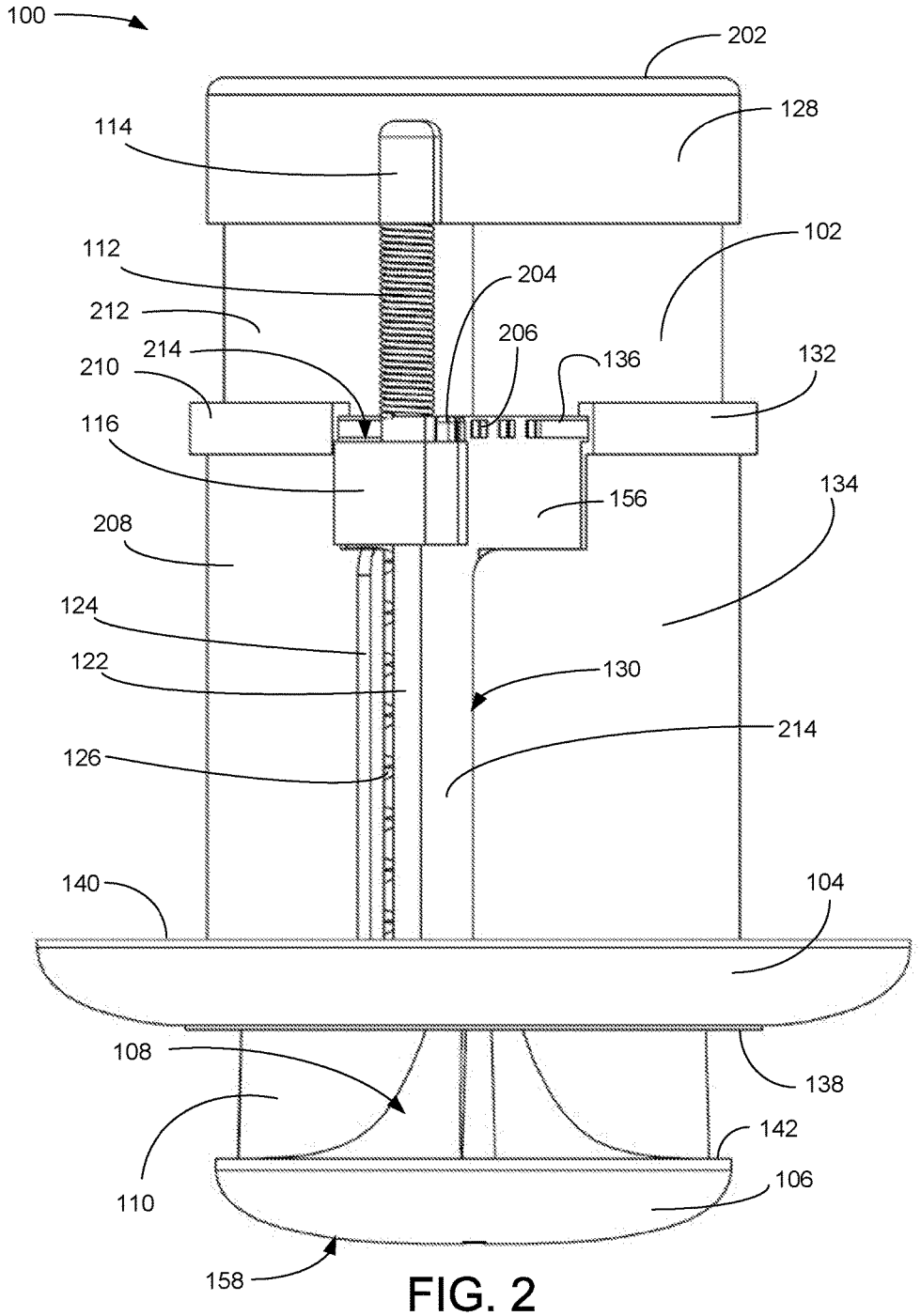
FIG. 2 is a side elevation view illustrating an exemplary embodiment of the small speaker system of FIG. 1, according to a preferred embodiment of the present invention.

FIG. 2 is a side elevation view illustrating an exemplary embodiment of the small speaker system 100 of FIG. 1 in a second configuration, according to a preferred embodiment of the present invention. In the illustrated configuration, first flip dog 116 has rotated out (flipped) and is about to descend under the urging of first coil spring 112. A first gear teeth section 206 extends from the cylindrical mechanism 156 aligned and sized to move in first channel 132. First gear teeth section 206 has engaged the flip dog gear 204 which extends from the top surface 214 at the radially inner end (when flipped) of first flip dog 116. The sloped surface of revolution 108 of the sound disperser 106 can be better understood from this view, as can fins 110. Second housing section 212 includes channel 210, lower portion 208, and semi-annular flange 302 (See FIG. 3), which are preferably all of one piece. The top 202 of cap 128, which is preferably all of one piece with cap 128, can be more clearly seen in this view.

Figure 3:
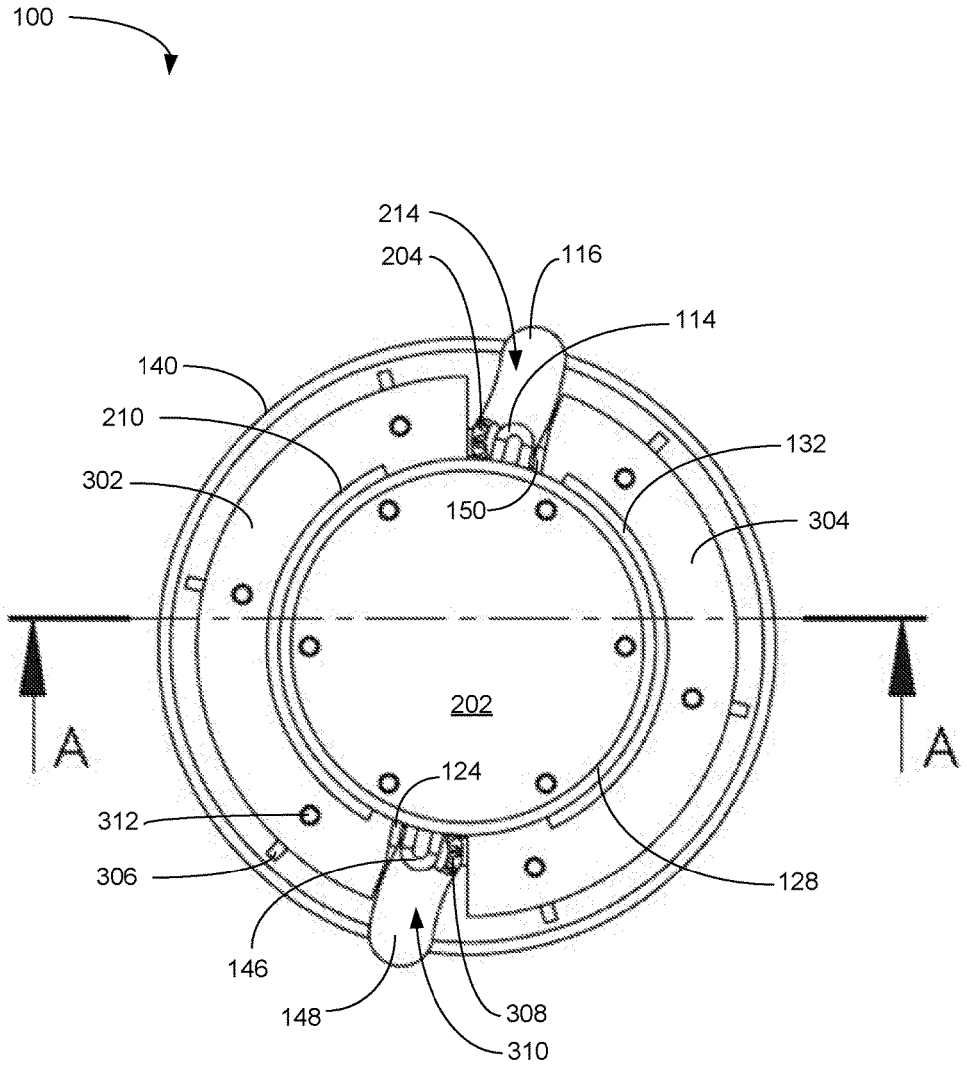
FIG. 3 is a top plan view illustrating an exemplary embodiment of the small speaker system of FIG. 1 and defining a chord cross section AA, according to a preferred embodiment of the present invention.

FIG. 3 is a top plan view illustrating an exemplary embodiment of the small speaker system 100 of FIG. 1 in the second configuration and defining a chord cross section AA, according to a preferred embodiment of the present invention. First and second semi-annular flanges 304 and 302 extend radially outward from the bottom of first and second housing sections 102 and 212, respectively, of which only channels 132 and 210, respectively, can be seen in this view. First and second flip dog gears 204 and 308 can be seen on the top surfaces 214 and 310, respectively, of flip dogs 116 and 148, respectively. Supports 306 (one of six labeled) are preferably of one piece with the annular frame 104 and provide flat surfaces for supporting semi-annular flanges 304 and 302. In addition, supports 306 provide receivers for receiving fasteners through fastener openings 312 (one of six labeled). In other embodiments, more or fewer supports 306 may be provided.

Figure 4:
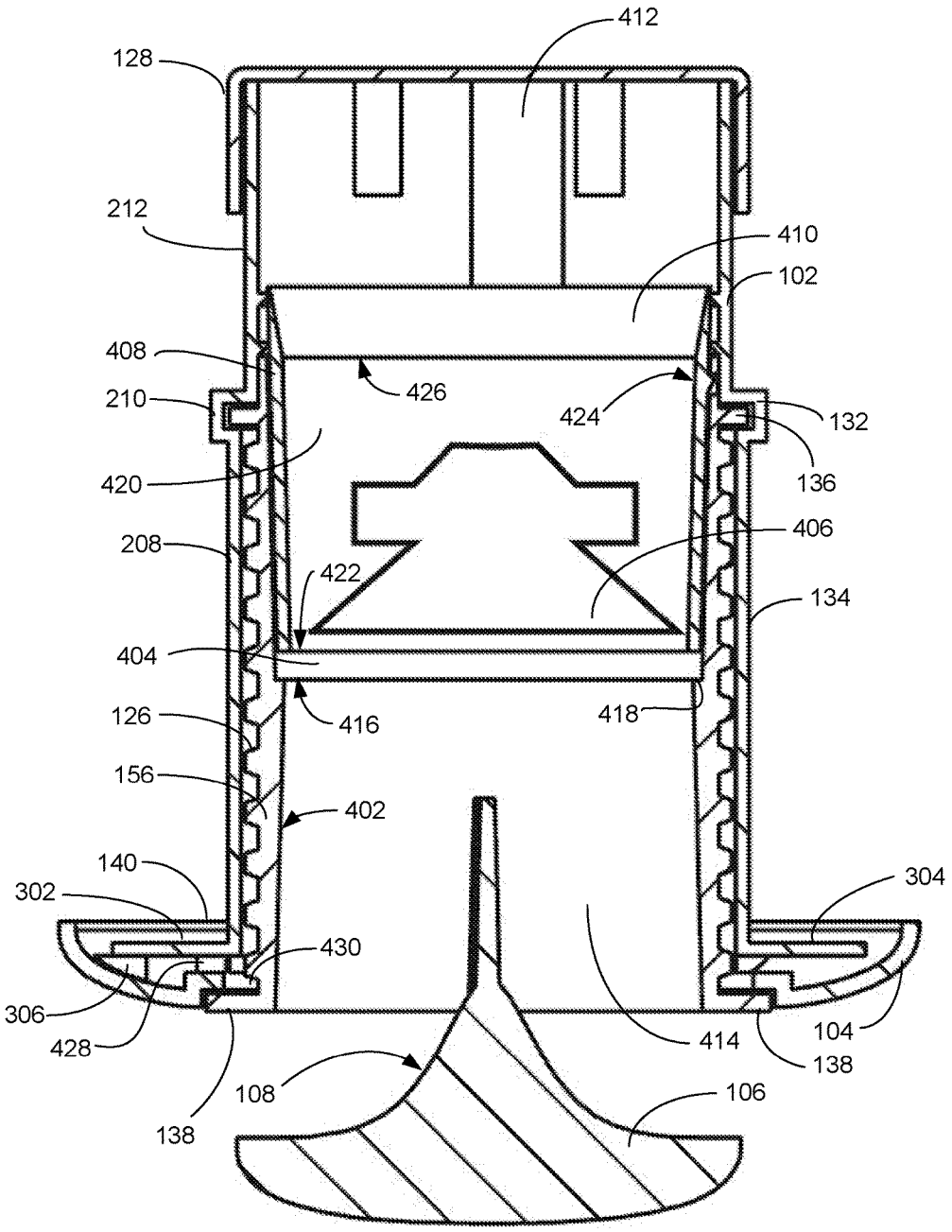
FIG. 4 is an augmented cross-sectional elevation view through cross section AA of FIG. 3 illustrating an exemplary embodiment of the small speaker system of FIG. 1, according to a preferred embodiment of the present invention.

FIG. 4 is an augmented cross-sectional elevation view through cross section AA of FIG. 3 illustrating an exemplary embodiment of the small speaker system 100 of FIG. 1, according to a preferred embodiment of the present invention. The one-piece construction of first housing section 102, including channel 132, lower portion 134, and semi-annular flange 304, can be clearly seen in this view. Likewise, the one-piece construction of second housing 212, including channel 210, lower portion 208, and semi-annular flange 302, can be clearly seen in this view. Sound disperser 106 receives downwardly directed sound waves from sound chamber 414, which is formed by the inside surface 402 of cylindrical mechanism 156 and the lower surface 416 of the speaker baffle 404. Speaker baffle is supported on an annular indentation 418 on the inside surface 402 of the cylindrical mechanism 156. Speaker baffle 404 has a vertical hole through it (not shown) through which sound from speaker 406 is passed into the sound chamber 414. Speaker chamber 420 is formed by the top surface 422 of speaker baffle 404, the inside surface 424 of cylindrical bushing 408, and the bottom surface 426 of chamber lid 410. While not shown, speaker 406 is attached to cylindrical bushing 408. Cap 128 covers speaker electronics 412, which may include, without limitation, an amplifier, a filter, a fuse, and a limiter.

Cylindrical mechanism 156 is snap fit 430 to annular frame 104 without preventing rotation of the cylindrical mechanism 156 relative to the annular frame 104. Hollow cylindrical mechanism 156 rotates about the long vertical central axis 806 (See FIG. 8) of the small speaker system 100 to move guide 136 through channel 132 to bring first gear teeth section 206 (and a similar second gear teeth section for second flip dog 148) into engagement with first flip dog gear 204 to rotate first flip dog 116 outward (and similarly for second flip dog gear 308 and second flip dog 148). Hollow cylindrical mechanism 156 also includes semi-annular teeth 126 which, during deployment, engage first flip dog teeth section 154 with ratcheting effect. Semi-annular teeth 126 are horizontally oriented and arranged in vertical spaced-apart arrays on opposed outer sides of hollow cylindrical mechanism 156, as shown.

FIG. 4 is augmented with a support 306 and a lower axle receiver 428, which would not ordinarily be visible in the cross section AA.

Figure 5:
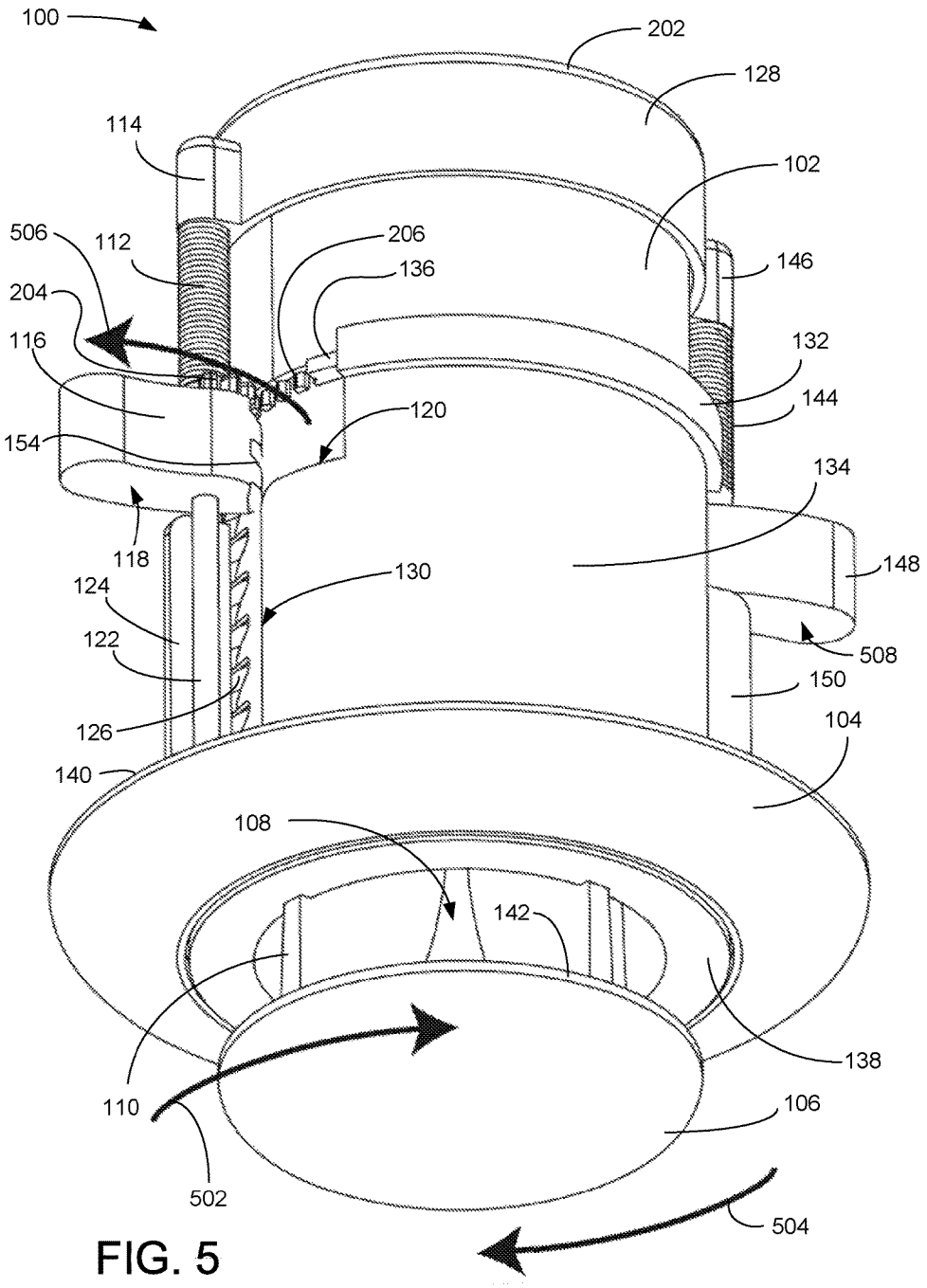
FIG. 5 is side-bottom perspective view illustrating an exemplary embodiment of the small speaker system of FIG. 1 in a second configuration, according to a preferred embodiment of the present invention.

FIG. 5 is side-bottom perspective view illustrating an exemplary embodiment of the small speaker system 100 of FIG. 1 in the second configuration, according to a preferred embodiment of the present invention. When the sound disperser 106 is rotated clockwise, as shown by arrows 502 and 504, first gear teeth section 206, extending from the hollow cylindrical mechanism 156, engage first flip dog gear 204 to rotate first flip dog 116 outward, as shown by arrow 506. Concurrently, second flip dog 148 is rotated out by a similar second gear teeth section (not shown) and second flip dog gear 308. The inward portion of first flip dog 116 is aligned between first guide 124 and the edge 130 of the lower portion 134 of first housing 102. Second flip dog 148 is similarly aligned on the opposing side of the small speaker system 100. The underside 508 of second flip dog 148 can be clearly seen in this view.

Figure 6:
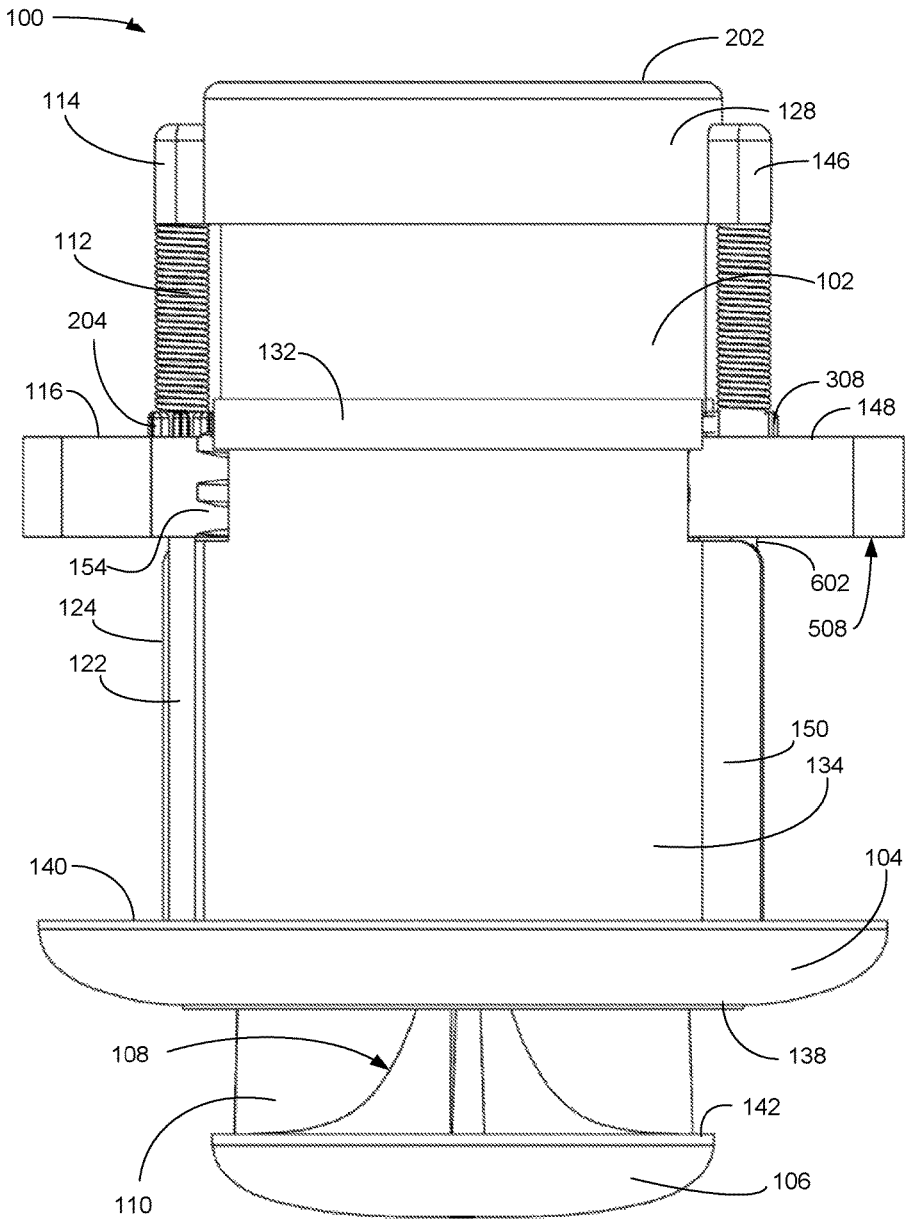
FIG. 6 is a side elevation view illustrating an exemplary embodiment of the small speaker system of FIG. 1 in the second configuration, according to a preferred embodiment of the present invention.

FIG. 6 is a side elevation view illustrating an exemplary embodiment of the small speaker system 100 of FIG. 1 in the second configuration, according to a preferred embodiment of the present invention. A small portion of second axle can be seen in this view. Both axles 122 and 602 seat in receivers 428 that are made of one piece with annular frame 104.

Figure 7:
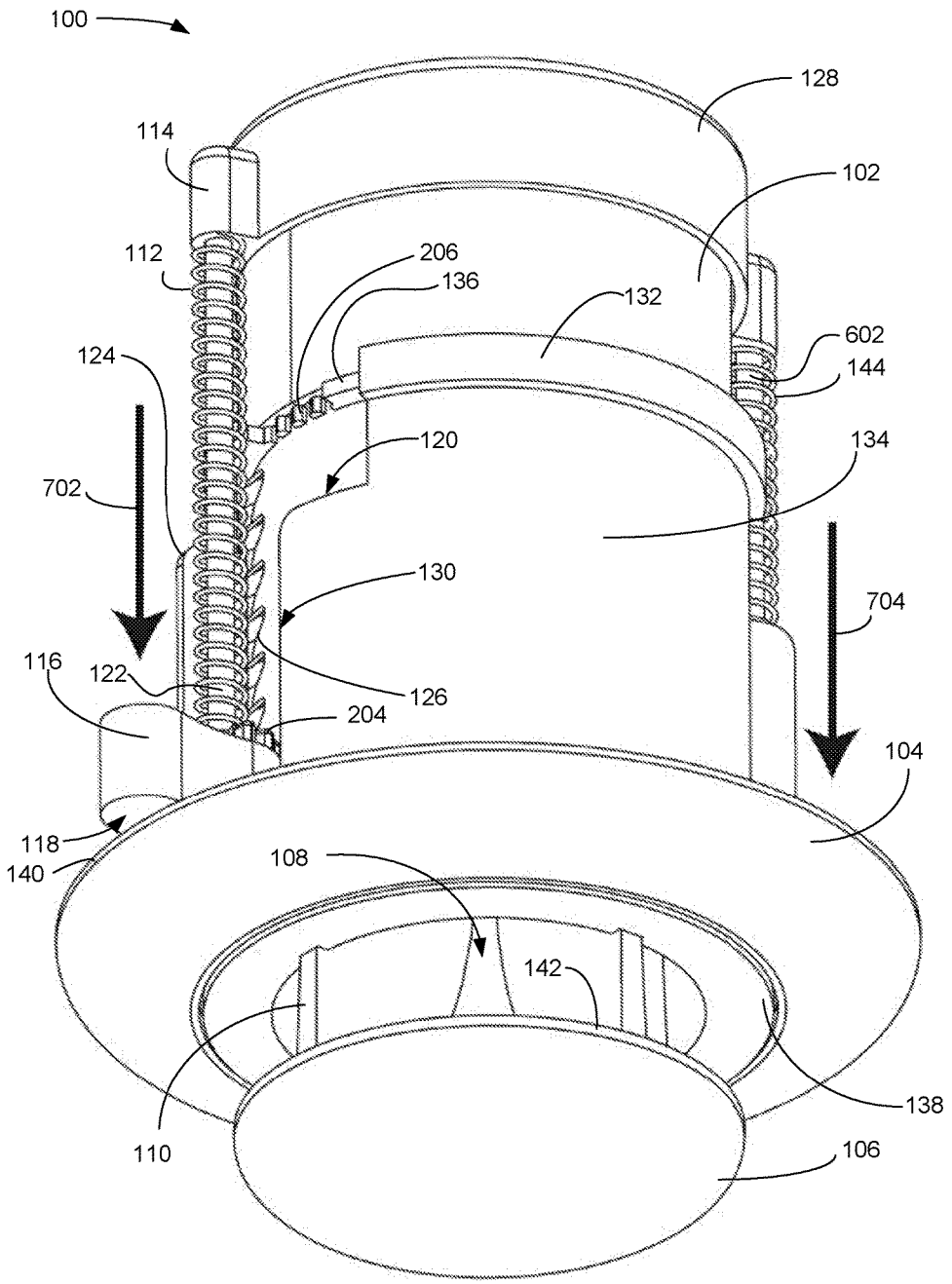
FIG. 7 is side-bottom perspective view illustrating an exemplary embodiment of the small speaker system of FIG. 1 in a third configuration, according to a preferred embodiment of the present invention.

FIG. 7 is side-bottom perspective view illustrating an exemplary embodiment of the small speaker system 100 of FIG. 1 in a third configuration, according to a preferred embodiment of the present invention. The third configuration is a deployed configuration, in which the flip dogs 116 and 148 have been urged downward (arrows 702 and 704) to form a clamp between the underside 118 of the first flip dog and the cylindrical portion 140 of annular frame 104 and between the underside 508 of second flip dog 148 and the cylindrical portion 140 of annular frame 104. Coil springs 112 and 144 are shown extended.

Figure 8:
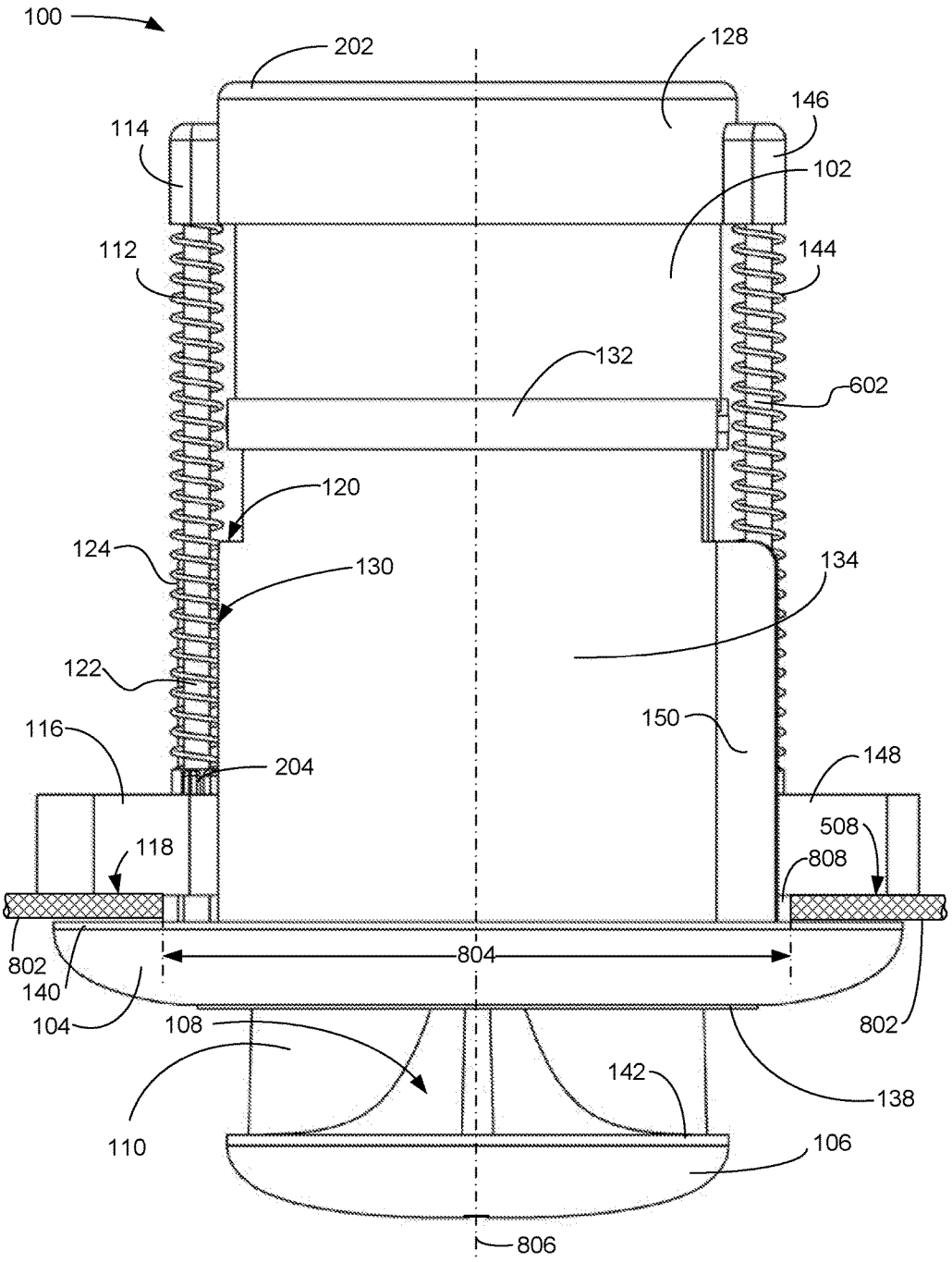
FIG. 8 is a side elevation view illustrating an exemplary embodiment of the small speaker system of FIG. 1 in the third configuration, according to a preferred embodiment of the present invention.

FIG. 8 is a side elevation view illustrating an exemplary embodiment of the small speaker system 100 of FIG. 1 in the third configuration, according to a preferred embodiment of the present invention. Panel 802 is shown clamped between flip dogs 116 and 148 and the top cylindrical portion 140 of annular frame 104. Panel 802 is shown with a hole 808 having a diameter 804, which is preferably no less than seventy five millimeters. Once the flip dogs 116 and 148 contact the panel 802, continued rotation of the sound disperser 106 fully engages first flip dog teeth section 154 and 152 with semi-annular teeth 126, which removes reliance on the coil springs 112 and 144 for maintaining clamping force. Sound disperser 106 is limited in rotation to 180 degrees. Sound disperser 106, cylindrical upper portion 142, sloped surface of revolution 108, fins 110, annular panel 138, and cylindrical mechanism 156 are all able to rotate together about long central axis 806.

To remove an installed small speaker system 100, the small speaker system 100 is pulled downward, preferably by the annular frame 104, with sufficient force to overcome the engagement of first and second flip dog teeth sections 154 and 152 with semi-annular teeth 126 and then, using the panel 802 to push upward on the flip dogs 116 and 148 to compress the coil springs 112 and 144, respectively. Once the coil springs 112 and 144 are fully compressed, sound disperser 106 may be rotated counter clockwise to return the flip dogs 116 and 148 to their stowed position, as shown in FIG. 1. Once the flip dogs 116 and 148 are stowed, the small speaker system 100 can be withdrawn from the hole 808 in panel 802.

Those of skill in the art, illuminated by the present disclosure, will appreciate the many possible embodiments of the invention, which are limited only by the claims below.

We claim:

1. A small speaker system comprising:
   a. an annular frame;
   b. first and second housing sections mounted on said annular frame;
   c. a hollow cylindrical mechanism snap fit to said annular frame and adapted to rotate within said first and second housing sections; and
   d. an annular indentation in an inner surface of said hollow cylindrical mechanism adapted to support a speaker baffle.

2. The small speaker system of claim 1, comprising a speaker supported proximate said speaker baffle.

3. The small speaker system of claim 1, comprising a cap receiving and covering top ends of said first and second housing sections.

4. The small speaker system of claim 3, comprising first and second vertical axles supported by respective first and second axle receivers, respectively, that are of one piece with said annular frame and by first and second top axle supports, respectively, extending from said cap.

5. The small speaker system of claim 4, comprising first and second channels on said first and second housing sections, respectively, adapted to slidingly receive first and second guides, respectively, and first and second gear teeth sections, respectively, extending from an external surface of said hollow cylindrical mechanism.

6. The small speaker system of claim 5, comprising first and second coil springs compressively mounted on said first and second vertical axles, respectively, between said first and second top axle supports, respectively, and first and second flip dogs, respectively, wherein said first and second flip dogs are rotationally and slidingly mounted on said first and second axles, respectively.

7. The small speaker system of claim 6, comprising first and second dog gears extending upward from top surfaces of said first and second flip dogs, respectively, adapted to engage said first and second gear teeth sections, respectively, to rotate said first and second flip dogs, respectively, when said hollow cylindrical mechanism is rotated.

8. The small speaker system of claim 7 comprising a sound disperser attached to said hollow cylindrical mechanism adapted to enable manual rotation of said hollow cylindrical mechanism.

9. The small speaker system of claim 4, comprising a plurality of semi-annular teeth extending outwardly from said external surface of said hollow cylindrical mechanism and oriented horizontally in first and second vertical spaced-apart arrays on opposing sides of said hollow cylindrical mechanism.

10. The small speaker system of claim 9, comprising first and second flip dog teeth sections extending from a rear portion of each of said first and second flip dogs, respectively, and adapted to engage said first and second vertical spaced-apart arrays of semi-annular teeth, respectively.

11. A small speaker system comprising:

a. an annular frame;

b. first and second housing sections mounted on said annular frame;

c. a hollow cylindrical mechanism snap fit to said annular frame and adapted to rotate within said first and second housing sections;

d. an annular indentation in an inner surface of said hollow cylindrical mechanism adapted to support a speaker baffle; and e. first and second channels on said first and second housing sections, respectively, adapted to slidingly receive first and second guides, respectively, and first and second gear teeth sections, respectively, extending from an external surface of said hollow cylindrical mechanism.

12. The small speaker system of claim 11, comprising:

a. a cylindrical bushing inside and aligned to said hollow cylindrical mechanism and supported on said speaker baffle; and b. a speaker supported on said cylindrical bushing proximate said speaker baffle.

13. The small speaker system of claim 11, comprising:

a. a cap receiving and covering top ends of said first and second housing sections; and b. first and second vertical axles supported by respective first and second receivers that are of one piece with said annular frame and by first and second top axle supports, respectively, extending from said cap.

14. The small speaker system of claim 13, comprising:

a. first and second coil springs compressively mounted on said first and second axles, respectively, between said first and second top axle supports, respectively, and first and second flip dogs, respectively, wherein said first and second flip dogs are rotationally and slidingly mounted on said first and second axles, respectively; and b. first and second dog gears extending upward from top surfaces of said first and second flip dogs, respectively, adapted to engage said first and second gear teeth, respectively, to rotate said first and second flip dogs, respectively, when said hollow cylindrical mechanism is rotated.

15. The small speaker system of claim 14, comprising a sound disperser attached to said hollow cylindrical mechanism adapted to enable manual rotation of said hollow cylindrical mechanism.

16. The small speaker system of claim 11, comprising first and second semi-annular teeth sections extending outwardly from said external surface of said hollow cylindrical mechanism and oriented horizontally in first and second vertically spaced-apart arrays on opposing sides of said hollow cylindrical mechanism, respectively.

17. The small speaker system of claim 16, comprising first and second flip dog teeth sections extending from a rear portion of each of said first and second flip dogs, respectively, and adapted to engage said first and second vertical spaced-apart arrays of semi-annular teeth, respectively.

18. A small speaker system comprising:

a. an annular frame;

b. first and second housing sections mounted on said annular frame;

c. a hollow cylindrical mechanism snap fit to said annular frame and adapted to rotate within said first and second housing sections;

d. an annular indentation in an inner surface of said hollow cylindrical mechanism adapted to support a speaker baffle;

e. first and second channels on said first and second housing sections, respectively, adapted to slidingly receive first and second guides, respectively, and first and second gear teeth sections, respectively, extending from an external surface of said hollow cylindrical mechanism;

f. a cylindrical bushing inside and aligned to said hollow cylindrical mechanism and supported on said speaker baffle;

g. a speaker supported on said cylindrical bushing proximate said speaker baffle;

h. a cap receiving and covering top ends of said first and second housing sections;

i. first and second vertical axles supported by respective first and second receivers that are of one piece with said annular frame and by first and second top axle supports, respectively, extending from said cap;

j. comprising first and second coil springs compressively mounted on said first and second vertical axles, respectively, between said first and second top axle supports, respectively, and first and second flip dogs, respectively, that are rotationally and slidingly mounted on said first and second axles, respectively; and k. first and second dog gears extending upward from top surfaces of said first and second flip dogs, respectively, adapted to engage said first and second gear teeth sections, respectively, to rotate said first and second flip dogs, respectively, when said hollow cylindrical mechanism is rotated.

19. The small speaker system of claim 18, comprising a sound disperser attached to said hollow cylindrical mechanism adapted to enable manual rotation of said hollow cylindrical mechanism.

20. The small speaker system of claim 19, comprising:

a. comprising first and second semi-annular teeth sections extending outwardly from said external surface of said hollow cylindrical mechanism and oriented horizontally in first and second vertically spaced-apart arrays on opposing sides of said hollow cylindrical mechanism, respectively; and b. first and second flip dog teeth sections extending from a rear portion of each of said first and second flip dogs, respectively, and adapted to engage said first and second vertical spaced-apart arrays of semi-annular teeth, respectively.

* * * * *